US008231023B2

(12) United States Patent
Petyhyrycz

(10) Patent No.: US 8,231,023 B2
(45) Date of Patent: Jul. 31, 2012

(54) CONSTRUCTION DEVICE AND METHOD

(75) Inventor: Bohdan M. Petyhyrycz, Calgary (CA)

(73) Assignee: Airis Corporation, Calgary (CA)

( * ) Notice: Subject to any disclaimer, the term of this patent is extended or adjusted under 35 U.S.C. 154(b) by 491 days.

(21) Appl. No.: 12/374,282

(22) PCT Filed: Jul. 17, 2007

(86) PCT No.: PCT/CA2007/001250
§ 371 (c)(1),
(2), (4) Date: Jan. 16, 2009

(87) PCT Pub. No.: WO2008/009106
PCT Pub. Date: Jan. 24, 2008

(65) Prior Publication Data

US 2009/0308778 A1 Dec. 17, 2009

(30) Foreign Application Priority Data

Jul. 17, 2006 (CA) ..... 2552656

(51) Int. Cl.
*B65D 6/28* (2006.01)
*B65D 8/18* (2006.01)

(52) U.S. Cl. ..... 220/4.26

(58) Field of Classification Search ..... 220/4.26, 220/4.27, 23.83, 23.4; 206/503, 508; 215/6; 446/124, 125
See application file for complete search history.

(56) References Cited

U.S. PATENT DOCUMENTS

| | | | | |
|---|---|---|---|---|
| 2,416,142 | A * | 2/1947 | Bennett | 220/4.26 |
| 2,645,375 | A * | 7/1953 | Topfer | 220/4.27 |
| 3,067,896 | A * | 12/1962 | Berg et al. | 215/12.1 |
| 5,535,908 | A * | 7/1996 | Sheu | 220/4.27 |
| 5,671,856 | A * | 9/1997 | Lisch | 220/4.27 |
| 6,253,944 | B1 * | 7/2001 | Osten | 220/8 |
| 7,066,323 | B1 | 6/2006 | Reisman | |
| 2007/0012693 | A1 | 1/2007 | Kummer | |

FOREIGN PATENT DOCUMENTS

| | | | |
|---|---|---|---|
| DE | 298 00 226 | U1 | 5/1999 |
| DE | 299 01 466 | U1 | 7/1999 |
| EP | 1038785 | A2 | 9/2000 |
| JP | 08318949 | A2 | 12/1996 |

OTHER PUBLICATIONS

Extended European Search Report mailed Dec. 2, 2010, issued in corresponding European Application No. EP 07 78 4951, filed Jul. 17, 2007, 7 pages.

* cited by examiner

*Primary Examiner* — Harry Grosso
(74) *Attorney, Agent, or Firm* — Christensen O'Connor Johnson Kindness PLLC

(57) ABSTRACT

Removal of the bottom end of a container, and provision of the container with threaded sections at both ends of the container allows multiple containers of the same type to be threaded together to form a tube.

24 Claims, 7 Drawing Sheets

CONSTRUCTION DEVICE AND METHOD

BACKGROUND

Containers may be recycled or re-used, but the design of the bottom, being closed, and the top, typically prevents more complicated objects being readily made from them.

SUMMARY

A container is configured to allow multiple containers to be joined together by removal of an end of the container body, and provision of suitable connectors formed in the container body. A method of creating a structure formed by multiple containers is provided. A construction system is provided with two or more sets of container bodies that may be connected together. A method of material transformation is also provided in which objects made for one use, with a secondary configuration suitable for another use, are combined and used for the other use.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
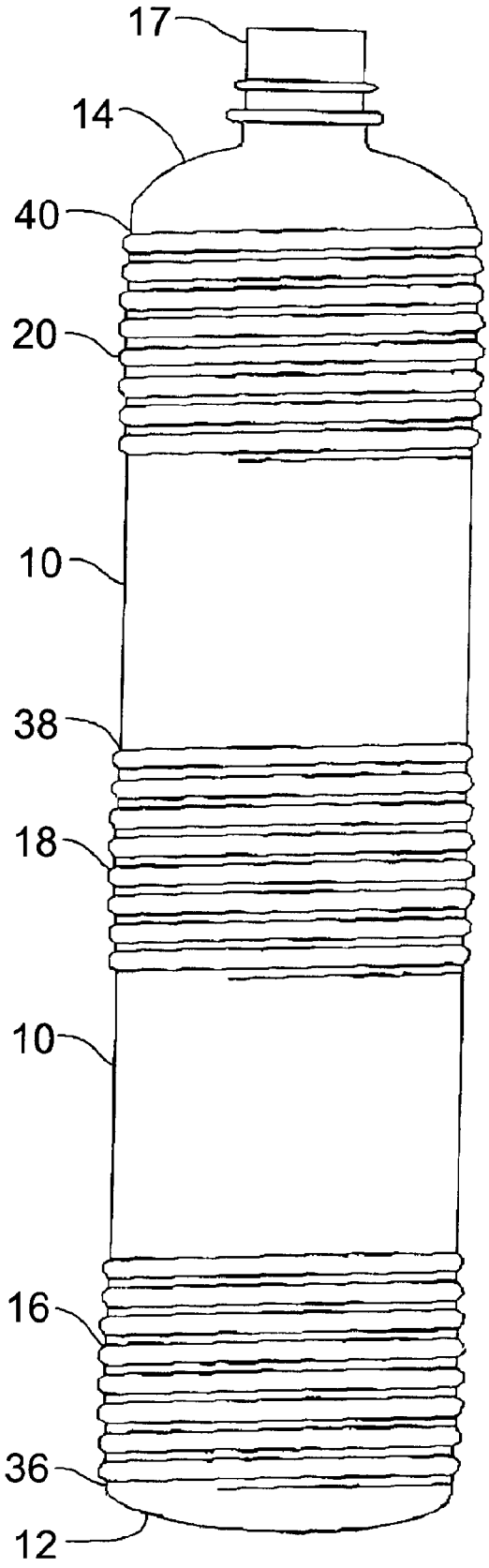
FIG. 1 shows an embodiment of a container.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims A container is formed of a container body 10 with a bottom end 12 and a top end 14. The term top end refers to the end that is normally at the top during use of the container. The top end will typically be open on initial construction of the container for deposit of material into the container. On purchase of a container at a store, the top end will typically be closed with a stopper, but will be opened in normal use. Thus, for example in the case of a beverage container the top end might have a threaded cap. In the case of a tennis ball container used for retail sale of tennis balls, the top end might be sealed with a metal cap. The term bottom end means the end that seals off the container when material is deposited into the container through the top end. The bottom end is typically closed in normal use and upon manufacture.

The container body 10 is shown as being tubular and may be made of molded plastic, such as by injection molding, or any other suitable method for forming a container, the suitability depending on the intended application. In the example shown in FIG. 1, the container is formed as a bottle, with a threaded top end 14. The container shown is exemplary. It is shown as cylindrical, but need not be in some embodiments. Also, it may in its normal use be pressurized or not, and it may contain liquids, solids, including various objects, and/or gases. The top end 14 need not be threaded, but may be capped in any suitable manner, and need not be narrower than the main body of the container. The container may also be formed as a pressurized tennis ball holding container, the cap of which may be removed by using a conventional tab. The container body 10 may be made of metal, plastic, or any other suitable material, and, if plastic or other pliable material, may be re-enforced with a stiffer material, such as metal, as in the case of a tennis ball can. The container may also be designed for any other suitable container use, and may have any suitable length or diameter. Containers of different diameters may be used coupled with adapters having different diameters at each end.

A connector 16, which in this embodiment is shown as a set of threads, is formed in the container body 10 at the bottom end 12, and a connector 18, which in this embodiment is shown as a set of threads, is formed in the container body 10 between the connector 16 and the top end 14. The connector 16 is configured to mate with the connector 18, that is, in the case of the embodiment shown, the connector 16 on a container body 10 will thread into or onto the connector 18 of another container body having the same construction as container body 10. A further connector 20 may also be formed in the container body 10. The connector 20 should also be designed to mate with connector 16. In a container body 10 with two connectors, the two connectors may be in the position of any two of the connectors 16, 18 or 20, or elsewhere on the container body 10, providing one of the two connectors is closer to the bottom end 12 and the other is closer to the top end 14.

Figure 1A:
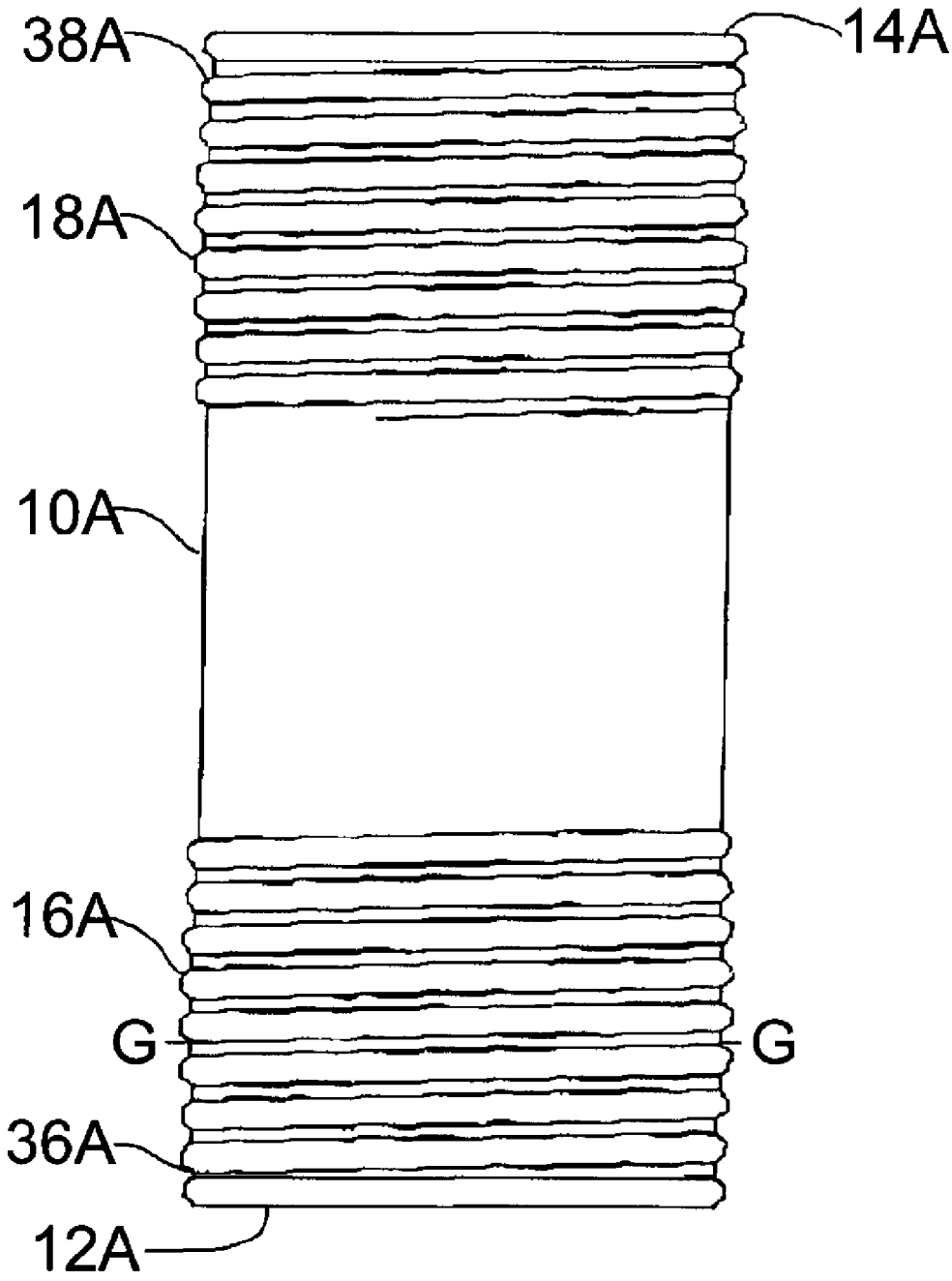
FIG. 1A shows an embodiment of a container formed as a tennis ball container.
Figure 5:
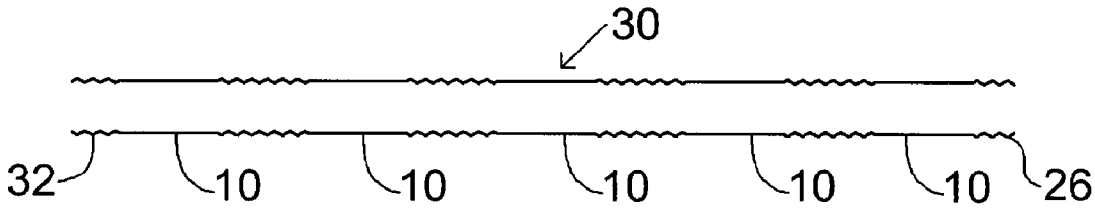
FIG. 5 shows an embodiment of a tube made using multiple containers of FIG. 1.

In one example, a container 10 may be formed as a tennis ball container 10A shown in FIG. 1A. A connector 16A, which in this embodiment is shown as a set of threads, is formed in the container body 10A at the bottom end 12A, and a connector 118A, which in this embodiment is shown as a set of threads, is formed in the container body 10A between the connector 16A and the top 14A. Top 14A may be a conventional top of a tennis ball container that may be peeled off. The connector 16A is configured to mate with the connector 18A, that is, in the case of the embodiment shown, the connector 16A on a container body 10A will thread into or onto the connector 18A of another container body having the same or similar construction as container body 10A. Intermediate connectors (not shown) may also be included in the container body 10A between the connectors 16A and 18A, should also be designed to mate with connector 16A. In this embodiment of FIG. 1A, removal of the bottom ends 12A on two containers 10A as for example by a cut at 36A allows connection of the two containers 10A to form a tube. With a number of such containers 10A with their bottom ends 12A removed, a tube of any desired length may be created for example a tube of a little over a meter in length that may be used to pick up and store tennis balls. A tube of such a design is shown in FIG. 5. A further container 10A may be cut at G-G in FIG. 1A and the end 12A of this container may then form a cap for the tube created by combining several containers 10A. The top ends 14A of these containers may or may not be removed, as for example by a cut at 38A, depending on the design of the connectors. That is, if the top end 14A is suitable wide and the bottom end of the threads at connector end 16A are suitable narrow, the connector end 16A will fit in the top end 14A of another container 10A without removal of the top end 14A. A conventional plastic lid of a tennis ball container may be used to cap the top end of the tube created by combining containers 10A.

Figure 2:
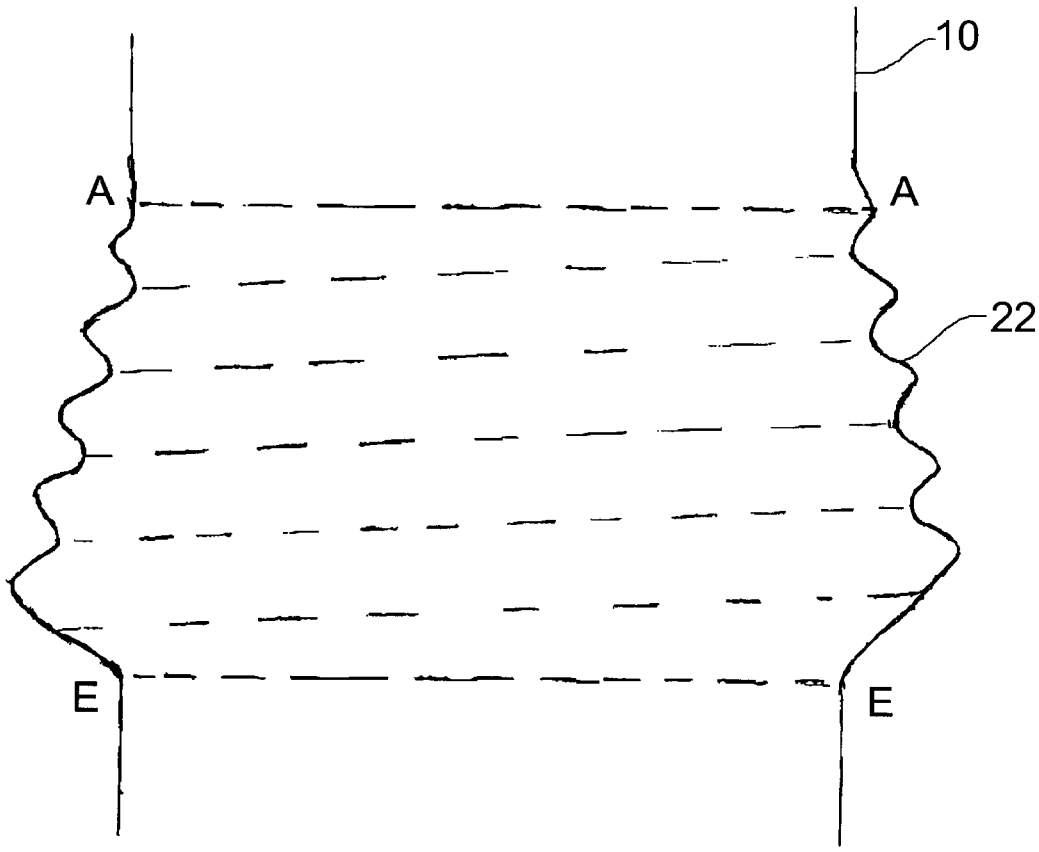
FIGS. 2 and 3 show connectors that may be used with the container of FIG. 1.
Figure 3:
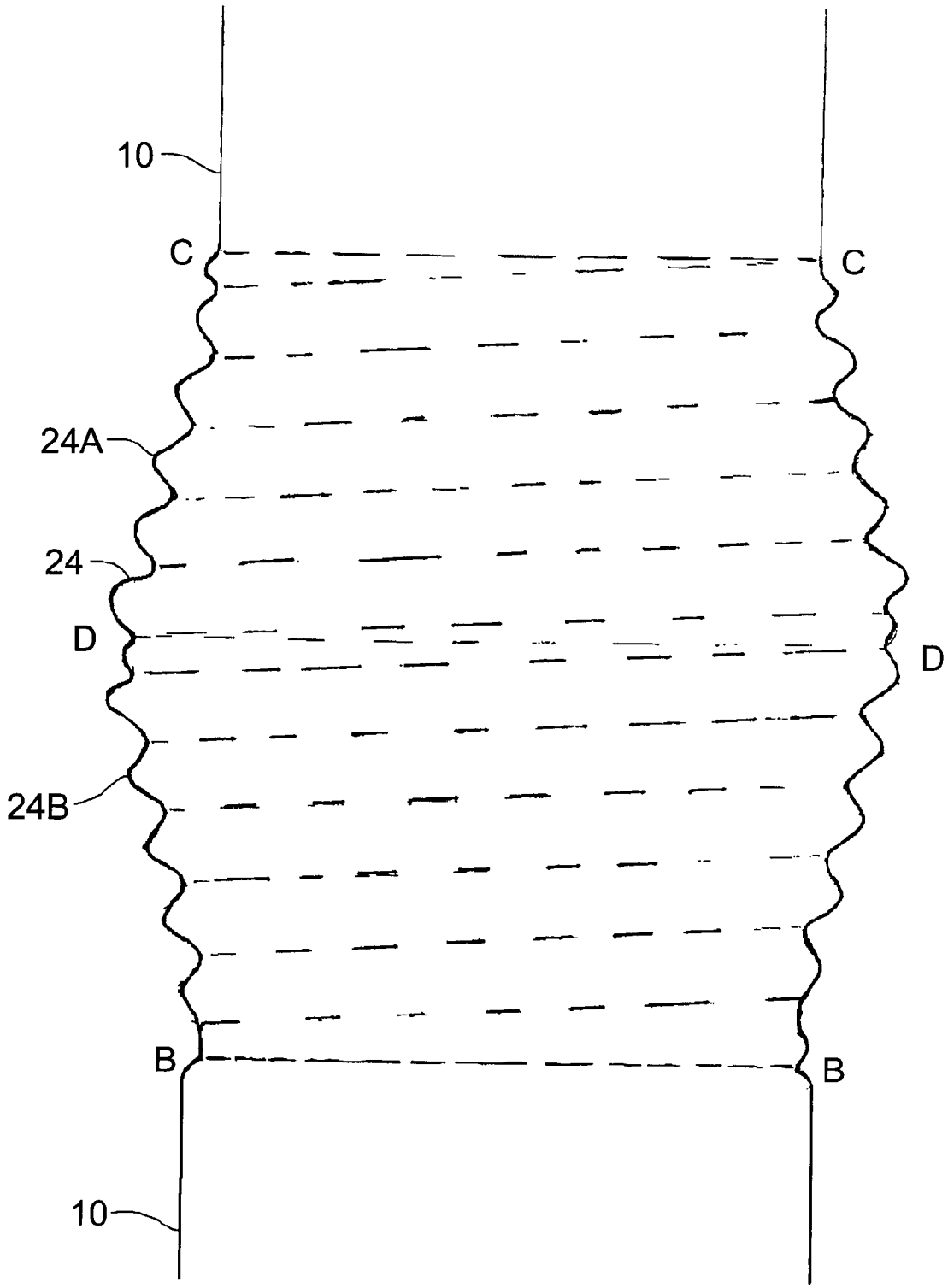

An example connector 22 is shown in FIG. 2. Connector 22 could be used for any of connectors 16, 18 or 20. Connector 22 is formed of a threaded portion of the container body 10 and expands towards one end of the container 10, which could be either the bottom or top end. When cut at A-A, the connector 22 forms a male connector. When cut at E-E, the connector 22 forms a female connector. When provided with suitable threads, a male configuration of connector 22 will mate with a female configuration of connector 22. A further example connector 24 formed in a container body 10 is shown in FIG. 3. The connector 24 could be used for any of the connectors 16, 18 or 20. In FIG. 3, connector 24 is a double connector with two threaded sections, 24A and 24B. When cut at D-D, the connector 24A forms a female connector, and when cut at B-B, the connector 24B forms a male connector. The connector 24 may also be cut at both B-B and C-C and used as a double male connector to join two container bodies 10 having female connector ends.

Figure 4:
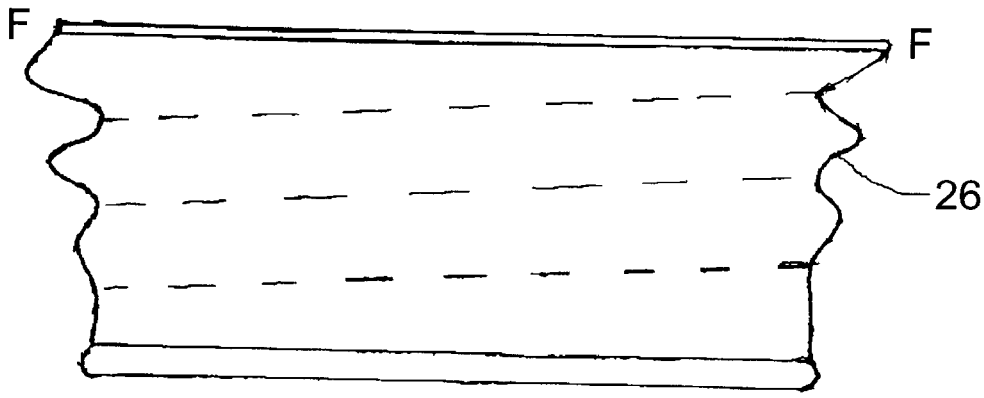
FIG. 4 shows an end cap for a container of FIG. 1.

Either of the connectors 22 or 24 may be located adjacent a bottom end 12 of the container body 10, for example as shown in FIG. 4. When cut at F-F, the device 26 shown in FIG. 4 may form a cap for a device of FIG. 1 with its bottom end 12 removed.

Two or more of the devices of FIG. 1 may be used to create a tube, which itself may also function as a container, by removing the bottom end from one of the container bodies and threading one of the connectors 16 or 18 into or onto a connector 18 or 20 of another container body. Depending on the construction of the top end of the other container, the top end may or may not need to be removed to expose the threads. In one embodiment, the connector 18 or 20 may be at the extreme end of the container body 10, and the container body 10 may then be closed with a cap secured by the connector 18 or 20. In this example, the removal of the cap would allow the connector 16 of another container body 10 to be connected to the connector 18 or 20. In another embodiment, such as shown in FIG. 1, a neck 17 of the container body 10 may require removal, such as by cutting of the container body, to expose the connector 18 or 20.

Figure 6:
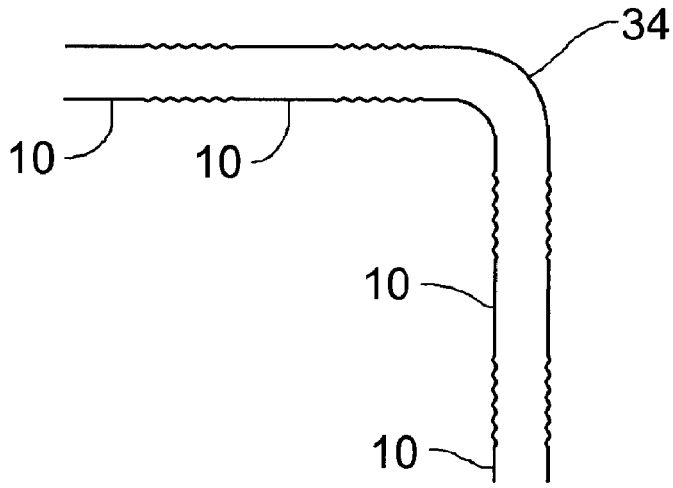
FIG. 6 shows a further embodiment of a tube made using multiple containers of FIG. 1.

This step of removing a bottom end of one container body and attaching that container body to a top end of another container body may be repeated with multiple container bodies to create a tube of any desired length. An example is shown in FIG. 5, where multiple container bodies 10 are joined together to form a tube 30. A further example of a device with multiple container bodies 10 is shown in FIG. 6, where one container body 34 of the container bodies 10 is curved.

The removal of the bottom end 12 from a container body may be accomplished by cutting the container body 10 at a suitable location for example at the points 36 and 38 or 40 as shown in FIG. 1, for example with scissors or a knife or other device suitable for the material being cut. The selection of the point 38 or 40 depends on the length of the tube required. A cut may also be made midway through the threads when the connectors 16, 18 or 20 are double ended connectors of the type shown in FIG. 3. In this instance, the cut is made in the threads along the line D-D shown in FIG. 3.

The tube 30 may be used to hold or retrieve game playing objects such as tennis balls, golf balls and hockey pucks. By placing an end of the tube 30 over a ball or puck, the ball or puck may be pushed into the tube 30 and held there by friction from the container walls. The end of the tube 30 used to grip the ball or puck may be provided by an end cap 26 with an opening sufficiently large to allow a ball to be pushed through it by hand force, but tight enough to prevent the balls from falling out of the tube only by their own weight. In another embodiment, the container end 32 is provided with suitable dimensions to just fit over the ball it is intended to retrieve, and the container may widen away from the end 32 to allow the ball or puck to move deeper into the tube. The container end 32 may be notched or threaded to provide friction for holding a ball or other object that is pressed into the container. Once used to retrieve balls or pucks, the tube 30 may be capped with a cap such as cap 26 that has no opening. The tube 30 may also be used as a map tube, mailing tube, sonic tube for concrete construction, as solar panel tubes, framing tubes, tent frame, bottle packaging, toy, food packaging, swimming pool lane divider, pipe, periscope and maze, for example a 3-D animal maze.

Figure 8:
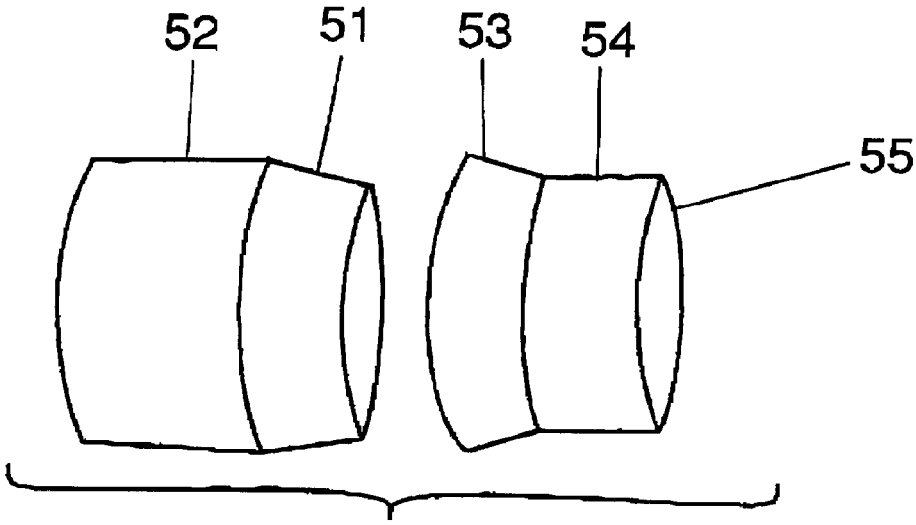
FIGS. 8-11 show examples of various connector types.
Figure 9:
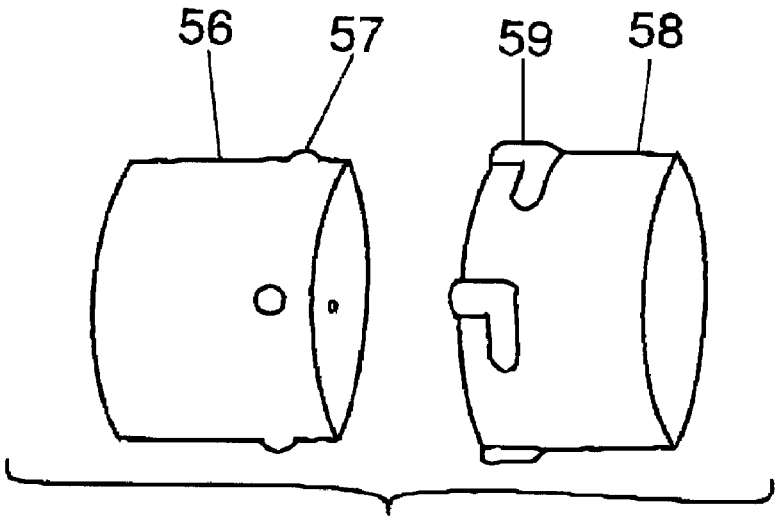
Figure 10:
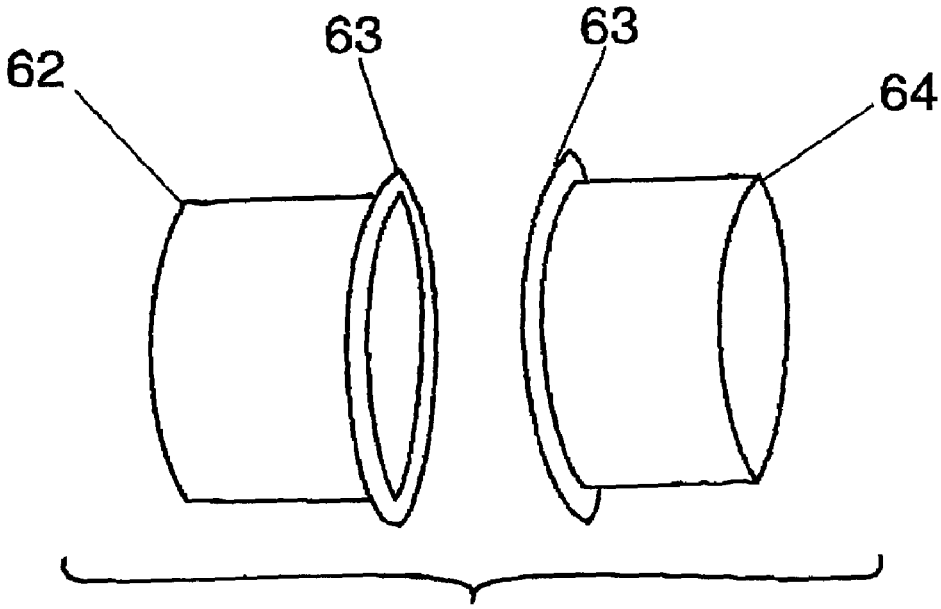
Figure 11:
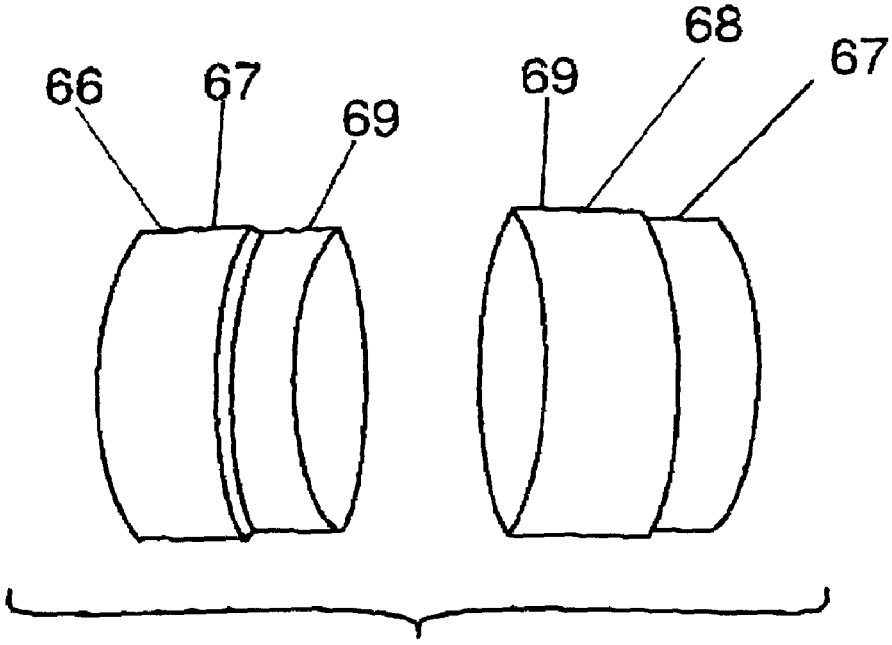

The connectors may be formed by other connecting devices as shown in FIGS. 8-11. Each of the connecting devices shown in FIGS. 8-11 may be located within a container body at the top or bottom end of the container body or may be intermediate in the container body and may replace the threaded sections shown in FIGS. 1-4. Hence, for example, either side of connector 52 in FIG. 8 may be a closed end that is cut off to allow connection of one container body with connector 52 to a container body having connector 54. Referring to FIG. 8, a male connector 52 may be formed with a conical end 51 that fits within the conical end 53 of a female connector 54. The connectors 52 and 54 may be held together with tape or glue for example. The connectors 52 and 54 may thus join two containers of different size. The conical end 51 of male connector 52 may also be formed on the cylindrical end 55 of connector 54, with a reduced diameter, so that the connector 54 may have both male and female ends for connecting containers of different sizes. Referring to FIG. 9, a male connector 56 has nubs 57 and a female connector 58 has L-shaped locking grooves 59 for receiving the nubs 57 on the inside of the grooves 59. The nubs 57 slide longitudinally into the grooves 59, and then the male connector 56 may be twisted to lock within female connector 58. FIG. 10 shows connectors 62 and 64 with respective flanges 63, which in this embodiment are identical and fit together by abutting their flange faces together and holding them with rivets, glue, tape, clamps, a locking ring that press fits over the flanges 63 or other suitable device. FIG. 11 shows a male connector 66 and female connector 68, which as shown are identical each with larger cylindrical end 67 that receives narrower cylindrical end 69 of smaller diameter for a press fit that may be held together with friction, glue, tape or other suitable fixative. The connectors 66 and 68 need not be cylindrical but may have other mating cross-sectional shapes. The change in diameter of each connector 66 and 68 and the thickness of the connector 66 and 68 may be chosen so that the connectors 66 and 68 are identical and the narrow end of either one may fit within the wider end of the other. Other suitable connectors may be used.

The container bodies 10 may also be provided in two sets. One set may only be provided with connectors of a specific type, such as male connectors, and another set may only be provided with connectors of a different specific type such as female connectors. In this embodiment, a tube 30 is made of alternating container bodies of the different types, or of one type connected by double ended connectors of the type shown in FIG. 3. The threads shown in FIG. 3 could be replaced by other suitable connectors such as those shown in FIGS. 8-11.

Figure 7:
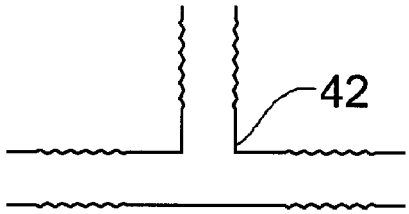
FIG. 7 shows a connector piece for use in an embodiment of container bodies used for example as a toy or construction device.

Provision of different sets of container bodies facilitates use of the container bodies as a toy or construction device. In this embodiment, additional container bodies with different geometric configurations may be provided, such as a curved body, a T-junction, shown in FIG. 7, a cross junction, star junction, U shape, or Y-junction configuration. In the case of the T-junction or any other junction, the container body has connectors 42 at each end of the parts of the T, cross, Y or star as the case may be. The connectors 42 may for example be of the type shown in FIG. 2 or 3.

In a tube construction system using container bodies of the type shown in FIG. 1, with either two or three connectors or more connectors in each container body, the closed or bottom ends of the container bodies need not be removed for construction if the connectors at the closed ends of the container bodies are male connectors. If the top end has female connectors, then the male connectors may be readily inserted in the female connectors to construct a device. In the case of a tube construction system with two or more sets of container bodies, each with the general construction shown in FIG. 1, but with one set of container bodies having only male connectors and one set of container bodies having only female connectors, the closed ends of the corresponding female connectors may need to be removed for construction. Removal of the closed end would not, for example, be required if the female connectors are formed in annular flanges forming a continuation of the container body beyond the bottom of the container.

There is thus provided a method material transformation. A first object, such as a bottle, with connectors, such as described, is obtained, for example by retail purchase. Another such object is obtained in like manner. Although both are manufactured and configured for a first purpose, such as a water bottle, they both have a secondary configuration, such as the connectors, formed for a new purpose, such as a construction toy. After the objects are used for their first purpose, they are combined, and perhaps altered, to become a new object, such as a construction toy, and used for the second purpose.

In the case where the containers require a separate component to be joined together, such as an adaptor to fit different sized parts together, a flange retention ring, glue, tape or other object, the additional components required may be sold as a kit. In the case of making an animal maze, various connectors, such as T-shaped connectors and star shaped connectors, may be sold as a kit with or without the containers themselves. Thus, the containers may be purchased separately or with the various adaptors and connectors.

Immaterial modifications may be made to the embodiments described here without departing from what is covered by the claims.

What is claimed is:

1. A container, comprising:

a container body having a bottom end and a top end;

a first connector formed in the container body at the bottom end;

a second connector formed in the container body between the first connector and the top end;

the first connector being configured to mate with the second connector; and at least one of the first connector and the second connector having a radial expansion from a first end to a second end of the at least one of the first connector and the second connector, the radial expansion being towards either the bottom end or the top end of the container body, such that, depending on whether the container body is cut across a diameter at the first end or the second end of the at least one of the first connector and the second connector, the at least one of the first connector and the second connector forms respectively either a male connector or a female connector.

2. The container of claim 1 in which each of the first connector and the second connector are threaded portions of the container body.

3. The container of claim 2 in which the container body, including the threaded portions, is formed of molded plastic.

4. The container of claim 1 in which at least one of the first connector and the second connector comprises a double ended connector.

5. The container of claim 1 further comprising a third connector formed in the container body between the second connector and the top end, the third connector being configured to mate with the first connector.

6. A method of creating a structure, comprising:

obtaining at least N container bodies, where N is at least two, each container body having a bottom end and a top end, with a first connector formed in the container body at the bottom end and a second connector formed in the container body between the first connector and the top end, the first connector being configured to mate with the second connector, the first connector having a radial expansion from a first end to a second end of the first connector, the radial expansion being towards one of the bottom end and the top end of the container body and the second connector having a radial expansion from a first end to a second end of the second connector, the radial expansion being towards one of the bottom end and the top end of the container body, such that, depending on whether the container body is cut across a diameter at the first end or the second end of either one of the first connector and the second connector, the respective one of the first connector and the second connector forms either a male connector or a female connector;

removing the bottom end from at least one of the container bodies; and connecting at least two container bodies by mating the first connector of the container body from which the bottom end has been removed with the second connector of another of the container bodies.

7. The method of claim 6 further comprising the step of removing the bottom end of the other of the container bodies.

8. The method of claim 6 in which:

N is at least three;

removing the bottom end from at least one of the container bodies comprises removing the bottom end from at least N−1 of the container bodies; and connecting at least two container bodies comprises connecting the N container bodies together by mating the first connector of a connector body from which the bottom end has been removed with a second connector of another of the container bodies.

9. The method of claim 8 further comprising using the connected container bodies as a ball collector.

10. The method of claim 6 in which the container bodies are tubular.

11. The method of claim 6 in which at least one of the container bodies is curved.

12. The method of claim 6 in which each of the first connectors and the second connectors are threaded portions of the container bodies in which the first connectors and second connectors are formed.

13. The method of claim 6 in which each container body is formed of molded plastic.

14. The method of claim 6 in which at least one of the first connector and the second connector of at least one of the container bodies comprises a double ended connector.

15. The method of claim 14 in which both of the first connector and the second connector of at least one of the container bodies comprise a respective double ended connector.

16. The method of claim 6 in which at least one of the container bodies comprises a third connector formed in the respective container body between the second connector and the top end, the third connector being configured to mate with the first connector of the respective container body.

17. A tube construction system, comprising:

a first set of container bodies, each container body of the first set having a closed end and an open end, a male connector formed in each container body of the first set at the respective closed ends, and a male connector formed in each container body between the open ends and the respective male connectors at the closed ends;

a second set of container bodies, each container body of the second set having a closed end and an open end, a female connector formed in each container body of the first set at the respective closed ends, and a female connector formed in each container body between the open ends and the respective female connectors at the closed ends; and the male connectors being configured to mate with the female connectors.

18. The tube construction system of claim 17 in which each of the male connectors and the female connectors are threaded portions of the respective connector bodies.

19. The tube construction system of claim 17 in which the container bodies, including the threaded portions, are formed of molded plastic.

20. The tube construction system of claim 17 further comprising a set of double ended connectors.

21. A container, comprising:

a container body having a bottom end and a top end;

a first connector formed in the container body at the bottom end;

a second connector formed in the container body between the first connector and the top end;

the first connector being configured to mate with the second connector; and at least one of the first connector and the second connector comprising a radially tapered double ended connector.

22. The container of claim 21 in which each of the first connector and the second connector are threaded portions of the connector body.

23. The container of claim 22 in which the container body, including the threaded portions, is formed of molded plastic.

24. The container of claim 21 further comprising a third connector formed in the container body between the second connector and the top end, the third connector being configured to mate with the first connector.

* * * * *